US011278078B2

(12) United States Patent
Fiorino et al.

(10) Patent No.: US 11,278,078 B2
(45) Date of Patent: Mar. 22, 2022

(54) PROTECTION HELMET

(71) Applicant: Momo Design S.r.l., Milan (IT)

(72) Inventors: Klaus Fiorino, Milan (IT); Paolo Pier Gaspare Cattaneo, Milan (IT)

( * ) Notice: Subject to any disclaimer, the term of this patent is extended or adjusted under 35 U.S.C. 154(b) by 0 days.

(21) Appl. No.: 17/285,378

(22) PCT Filed: Oct. 16, 2019

(86) PCT No.: PCT/IB2019/058828
§ 371 (c)(1),
(2) Date: Apr. 14, 2021

(87) PCT Pub. No.: WO2020/079615
PCT Pub. Date: Apr. 23, 2020

(65) Prior Publication Data

US 2021/0321711 A1 Oct. 21, 2021

(30) Foreign Application Priority Data

Oct. 19, 2018 (IT) ..... 102018000009613

(51) Int. Cl.
*A42B 3/22* (2006.01)

(52) U.S. Cl.
CPC ..... *A42B 3/222* (2013.01)

(58) Field of Classification Search
CPC ..... A42B 3/221; A42B 3/223; A42B 3/225; A42B 3/228; A42B 3/222
See application file for complete search history.

(56) References Cited

FOREIGN PATENT DOCUMENTS

| | | | | |
|---|---|---|---|---|
| CN | 202112389 U | 1/2012 | | |
| EP | 0521320 A1 * | 1/1993 | ..... | A42B 3/222 |
| EP | 0521320 A1 | 1/1993 | | |
| JP | S5991321 U | 6/1984 | | |

* cited by examiner

*Primary Examiner* — Katherine M Moran
*Assistant Examiner* — Erick I Lopez
(74) *Attorney, Agent, or Firm* — Themis Law

(57) ABSTRACT

A protection helmet includes a rigid body having a shaped front edge, a visor with an upper edge, and a pair of handling devices anchored to the body so as to enable its movement between a lowered position, in which its upper edge is in proximity of the front edge of the body, and a lifted position, in which the upper edge is above the front edge and is facing towards the back portion of the body. Each handling device includes a first connection member connected to the visor, a first movable pin associated with the connection member, a first shaped seat designed to slidingly house the movable pin, and a fixed pivot associated to the first connection member. Each handling device also includes a second connection member distinct from the first connection member and having ends respectively hinged to the first connection member and to the fixed pivot.

3 Claims, 7 Drawing Sheets

PROTECTION HELMET

FIELD OF APPLICATION OF THE INVENTION

The present invention concerns the technical sector of the safety devices designed to be worn by a user and its subject is a protection helmet.

More specifically, the present invention concerns protection helmets provided with a transparent or semi-transparent visor designed to protect the eyes and the upper part of the face of a user against any contact with external agents such as air, water, dust, etc.

STATE OF THE ART

The use of a protection helmet provided with a visor is required in several contexts. Just to mention some examples, the use of this protection element is established in several types of sports (skiing and motorsport), in urban mobility (protection helmets for motorcycles, bicycles or similar means of transport) and even in the sector of safety in the workplace (protection helmets for building sites or dangerous places).

All these types of helmets are constituted by a body made of a rigid material, on which a transparent or semi-transparent visor is mounted. The visor can be moved between a lowered position, in which it is substantially arranged in front of the user's eyes, and a lifted position, in which it is arranged out of the user's field of vision.

The body is provided with a shaped front edge designed to be arranged in proximity to the user's face, while the inside of the body is often covered with soft padding that makes it possible to comfortably envelop the user's head when the latter is inside the helmet.

The padding also makes it possible to fill the air space which is present between the user's head and the body, in such a way as to prevent the latter from moving during use and to maintain the front edge centered with respect to the face of the user also when the latter moves his/her head suddenly.

The helmets with visor furthermore comprise a pair of handling devices arranged on the opposite sides of the body and suited to selectively allow the movement of the visor between the lowered position and the lifted position.

More specifically, when the visor is in the lowered position its upper edge is substantially in contact with the open front edge of the body, while when the visor is in the lifted position the visor is generally facing towards the back portion of the body, in such a way as to remain totally (or almost totally) above the front edge of the body.

Therefore, the handling devices are designed to allow the rotational-translational movement of the visor: passing from the lifted position to the lowered position, the visor performs first a rotary motion along a line which is substantially parallel to the extension of the outer surface of the body and then translates forward until it comes in contact with the front edge of the body.

As is known, the visor handling devices are often subject to deterioration caused by the passage of time, by continuous use and by the specific way how the components used in them are made.

More specifically, the movement of the visor tends to become less smooth over time and the user needs to increase the intensity of the force applied to the visor in order to move it between its end positions.

Furthermore, the kinematic mechanism present inside the devices is subject to wear and therefore the inner components may become rigid and be subject to jams which tend to cause the visor to move in an abrupt and discontinuous manner.

In order to overcome these problems, several particular configurations of visor handling devices have been conceived, which present improvements compared to those mentioned above.

From EP2 229 829 is known a helmet comprising a shell suited to be placed in contact with a user's head and provided with a front portion and a back portion. The front portion has a lower edge and there is also a visor which is provided with a lower portion, too. There are also two guide devices suited to accommodate the visor and positioned on opposite sides of the shell. The guide mechanisms make it possible to guide the lower portion of the visor along a path which is delimited by a retracted position (substantially outside the user's field of vision) and a lowered position in which the visor is substantially below the front lower edge and within the user's field of vision.

The special characteristic of this solution lies in that the visor is provided with a front gasket positioned in proximity to its lower portion. The guide devices are configured to guide this portion of the visor towards the back portion of the shell when the visor is moved to the lowered position, in such a way that during use the facial gasket is in contact with the user's face.

However, the handling devices used in this helmet have a relatively complex configuration, as they consist of a system of levers hinged on two or more fulcrum points.

The patent document U.S. Pat. No. 8,555,424 describes a helmet with a shell provided with a front portion having a front lower edge, a visor and a front gasket intended to be mounted in proximity to the lower portion of the visor. Handling means are also provided, as well as two guide devices, each one of which is arranged on a different side of the shell to guide the visor along a predetermined trajectory. Each guide mechanism comprises a guide track consisting of a first track portion and a second track portion; the first track portion comprises a rotation section and a translation section that extend parallel to a longitudinal axis passing through the shell. There are a first pin that slidingly engages said first track portion and a second pin that slidingly engages the second track portion. The guide devices make it possible to move the visor along a predefined trajectory intended to allow it to be respectively arranged in a lowered position and in a lifted position. The handling means are suited to allow the movement of the visor towards said lowered position in such a way that the gasket, when in operating conditions, is in contact with the user's face along a direction that is substantially perpendicular to the latter.

Even in this case, the presence of a pair of tracks with respective pins sliding therein increases the overall friction of the visor handling devices and this can affect the smooth movement of the visor between its end positions.

Furthermore, when the visor is in the completely lowered or in the completely lifted position the user needs to exert a non-negligible force in order to overcome the initial resistance offered by the handling devices due to the friction present between the pins and the respective tracks.

The patent documents EP0521320, JPS5991321 and CN202112389 describe protection helmets which are particularly suited to be used in motorsport. These helmets, however, pose all the drawbacks that have already been described with reference to the protection devices mentioned above.

PRESENTATION OF THE INVENTION

The present invention intends to overcome the drawbacks mentioned above by providing a protection helmet that is suited to allow a particularly smooth movement of the visor between a completely lowered position and a completely lifted position.

It is a further object of the present invention to provide a protection helmet where it is particularly easy for the user to move the visor.

It is another object of the present invention to provide a protection helmet where the resistance of the visor to the motion applied to it between its end positions is maintained unaltered over time.

It is a further object of the present invention to provide a protection helmet made with a limited number of components configured in such a way that each of them has long duration, so as to limit the overall wear of the helmet and guarantee the full functionality of the device also for particularly long time intervals.

More specifically, the helmet that is the subject of the present invention makes it possible to protect the visor handling devices against the atmospheric agents and the micro impacts to which they can be subjected during use (dust, UV rays, ice, water, debris, etc.).

It is another object of the present invention to provide a protection helmet that is particularly silent during use.

It is another, yet not less important object of the present invention to provide a protection helmet that improves the user's safety in the case where he/she is involved in a collision with an object or slides on the ground or on other very hard surfaces.

These objects, together with others that will be clarified in greater detail below, are achieved by a protection helmet according to claim 1.

The particular configuration of the handling devices allows the visor to be moved very smoothly and without jams between the lowered position and the lifted position.

In a particular embodiment, the protection helmet may comprise a second movable pin placed in proximity to the anchorage point between the first connection member and the second connection member.

Advantageously, the presence of a pair of movable pins operatively connected to the fixed pivot makes it possible to obtain a particularly smooth movement of the visor (that is, with reduced friction) between its end positions.

According to a further embodiment, the first connection member is constituted by a first shaped rod and the second connection member is constituted by a second straight rod, wherein the first rod has one end connected to one end of the second rod through the second movable pin. Furthermore, the first rod can be connected to the visor in proximity to the lower edge of the latter.

This configuration makes it possible to reduce the overall dimensions of the handling devices which, therefore, can be easily integrated in the body. Furthermore, the visor is connected to the handling devices only in a single point (the end of the first rod) and therefore this solution considerably simplifies the construction of the visor itself, which does not need to be provided with any specific projecting element for connection to the helmet.

According to the invention, a supporting plate can also be provided, which is intended to define the fixed pivot and to accommodate the first connection member, the second connection member and a biasing member. This plate can have a specific geometric configuration designed to allow the housing of components used in the device in relatively small and narrow spaces.

In this way, the handling devices have particularly limited thickness, which facilitates their assembly on the inner surface of the body.

The advantages produced by the anchorage of the handling devices inside the helmet are multiple, the most considerable one being represented by the fact that the helmet is very silent for the user who is wearing it.

In addition to the above, a further advantage of this configuration lies in that it is possible to make the external surface of the body without external projections or protrusions (which are generated when the handling devices are anchored to the outside of the body).

These projections can be dangerous in the case where the user slips on the ground, since they can cause abrupt rotations of the head if the helmet impacts against protruding or sharp objects that may be present along the path on which he/she slips.

On the contrary, owing to the fact that the handling devices are integrated in the body, the helmet can slide on the ground in a smoother and more linear manner, which avoids the generation of sudden rotations or jams following the contact of the body with the objects spread along the path.

Thanks to this special solution, it is possible to increase the safety of the helmet for the user, in fact the risk of the latter's suffering cervical spine injuries while slipping on the ground is reduced.

Furthermore, the internal arrangement of the handling devices makes it possible to protect the components from atmospheric agents, UV rays, dust, ice, debris, as well as from the micro impacts which can occur during the use of the helmet.

Further objects that are described in greater detail below are achieved by a protection helmet according to the dependent claims.

BRIEF DESCRIPTION OF THE DRAWINGS

The advantages and characteristics of the present invention will clearly emerge from the following detailed description of a preferred but non-limiting configuration of a protection helmet, with special reference to the following drawings:

FIGS. 2A and 2B show side views of FIGS. 1A and 1B;

Figure 1A:
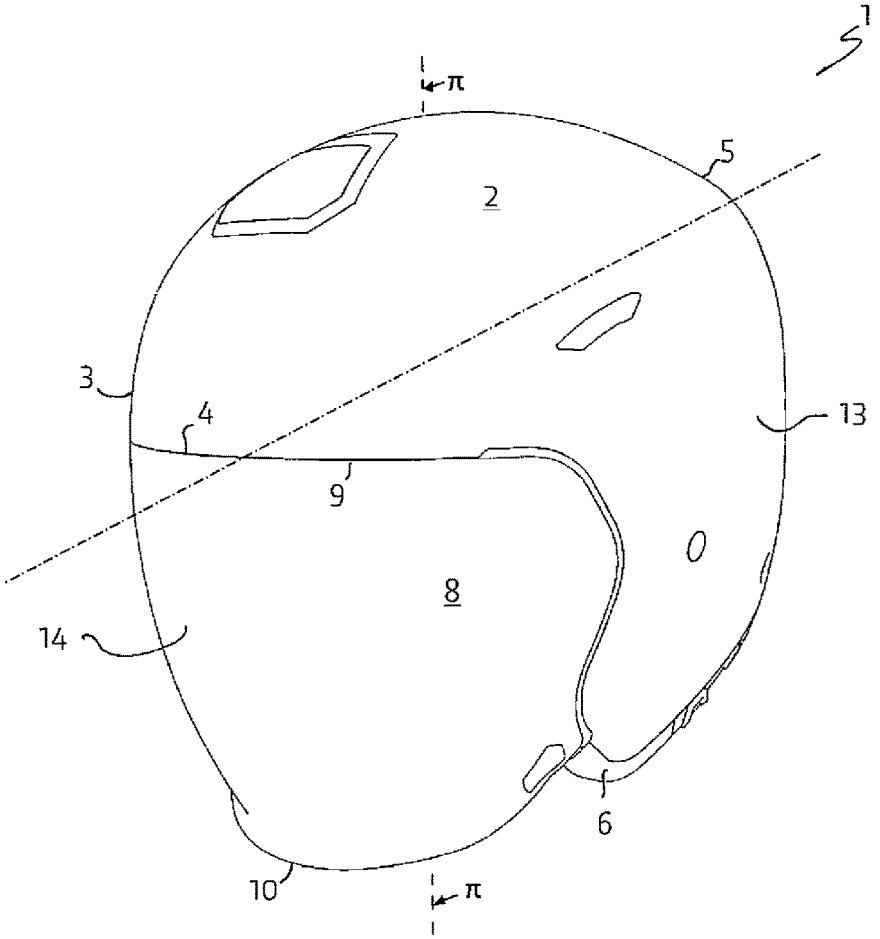
FIGS. 1A and 2B show perspective top views of a protection helmet according to the invention, with the visor in the lowered and in the lifted position.

FIGS. from 4A to 4C respectively show exploded perspective views of a second detail used in the helmet of FIG. 1A;

FIGS. from 5A to 5C show first internal sectional views of the helmet shown in FIG. 1;

FIGS. from 6A to 6C show second internal sectional views of the helmet of FIG. 1.

DETAILED DESCRIPTION OF THE INVENTION

The subject of the present invention is a protection helmet indicated by the reference numeral 1 here below. FIGS. from 1A to 6C show a particular configuration of a helmet for motorcycles, however this choice has been made only for the purpose of providing an example, as the protection helmet which is the subject of the present invention can be used in different fields, different from motorsport.

For example, the protection helmet described below can be conveniently adapted so that it can be used as a safety helmet for bicycles, as a ski helmet, as a protection helmet to be used in building sites or for other similar applications.

The helmet 1 which is the subject of the present invention comprises a body 2, substantially spherical or semi-spherical in shape and made of a rigid material resistant to impacts against particularly hard surfaces (for example, soil or asphalt) or against objects characterized by high hardness and solidity.

The body 2 can be made of any material presenting high resistance to impacts.

For example, the body 2 can be made of a polymeric material, mainly acrylonitrile butadiene styrene (ABS), through an injection moulding process. The polymeric material can also be loaded with different types of very hard materials such as, for example, composite fibers, glass fibers, carbon fibers etc.

Figure 3:
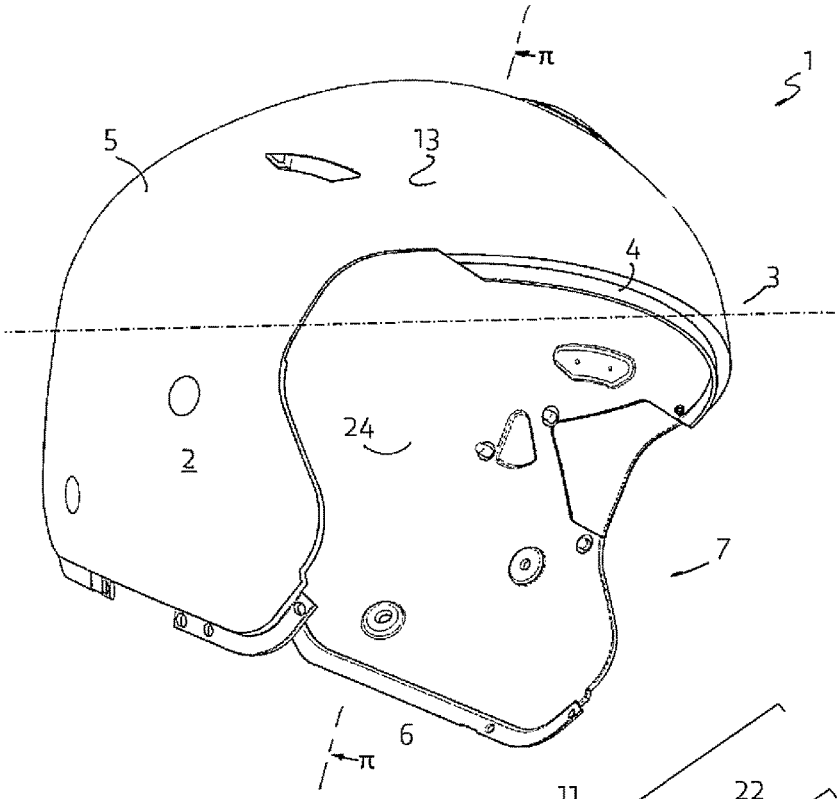
FIG. 3 shows a view from below of a first detail of the helmet shown in FIG. 1A.
Figure 4A:
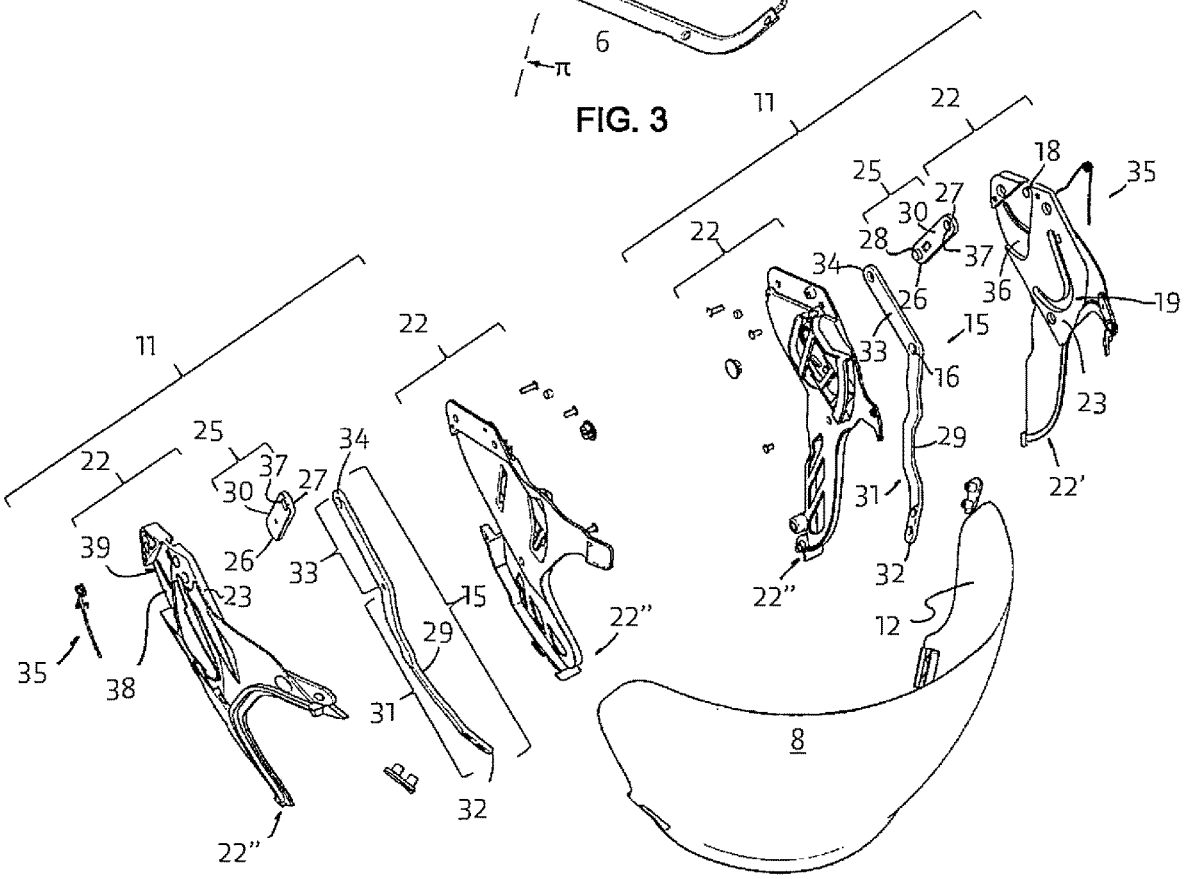
Figure 4B:
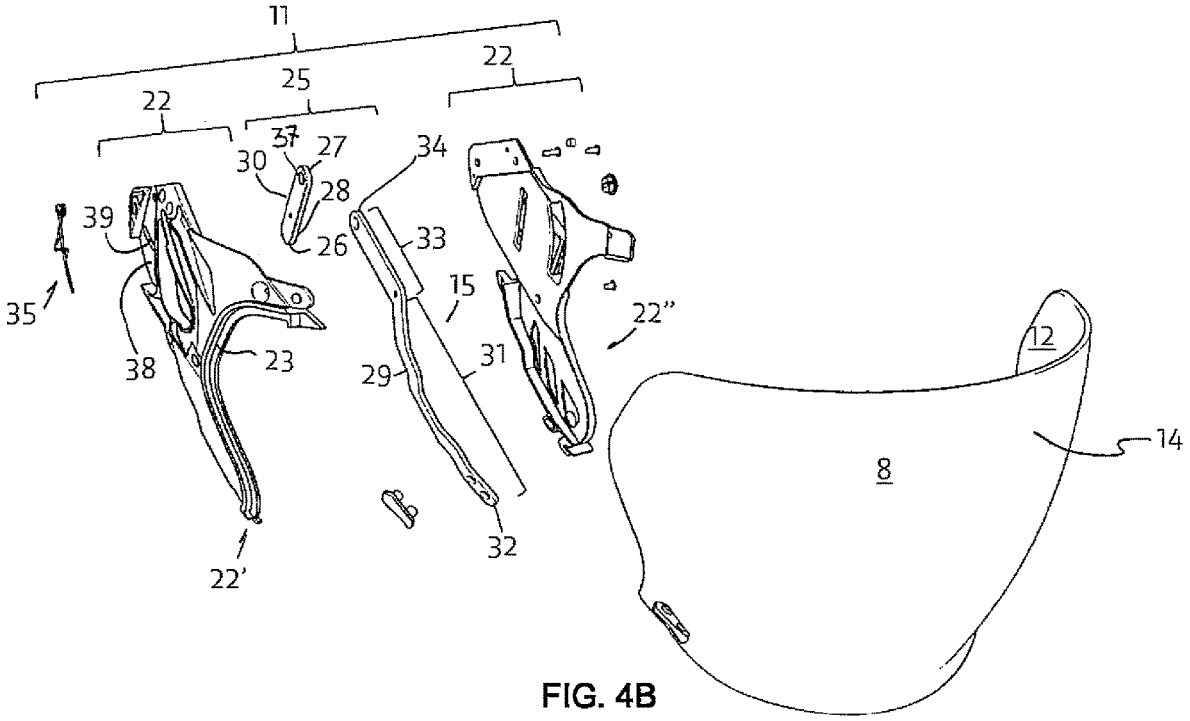
Figure 4C:
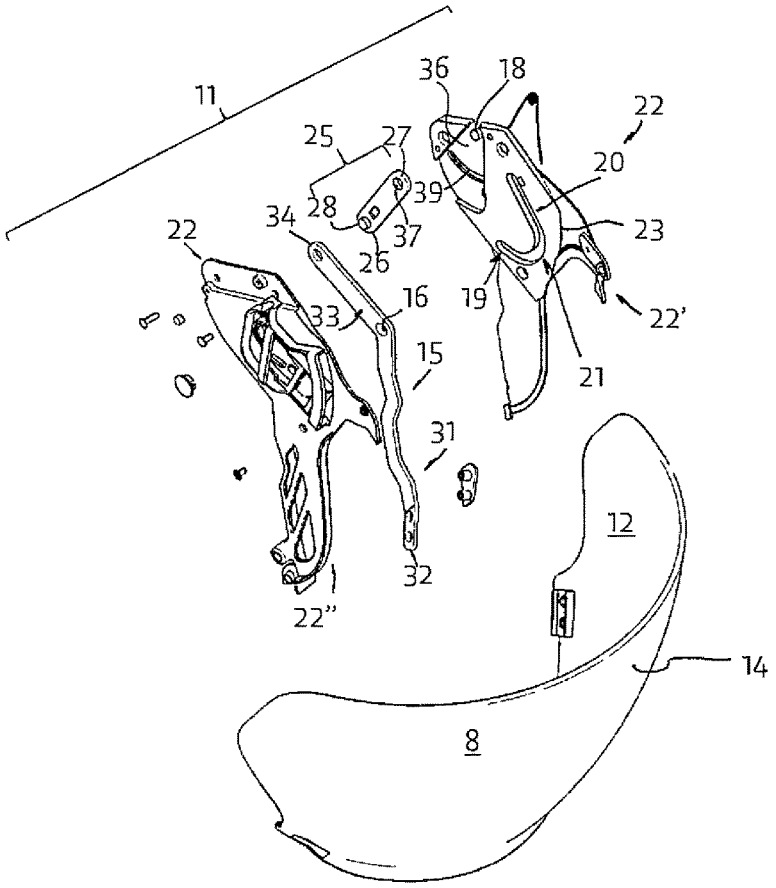

The body 2 is respectively provided with an open front portion 3 having a corresponding shaped front edge 4, better visible in FIGS. 1A and 3, and a closed back portion 5.

A lower edge 6 (open, too) is also provided, which is tapered with the front edge 4 in such a way that, together with the latter, it defines an opening 7 designed to allow the user's head to pass therethrough.

The helmet 1 comprises also a visor 8, generally transparent or semi-transparent, which is substantially spherical or semi-spherical in shape and is provided with an upper edge 9 and a lower edge 10.

More specifically, as is better visible in FIGS. from 1A to 2B, the lower edge 10 can be considerably raised, in such a way as to make it easier for the user to act on the visor 8 with his/her fingers when he/she wants to open or close it.

As can be better observed in FIGS. from 4A to 6C, a pair of handling devices is also provided, each indicated by the reference numeral 11, which are anchored on opposite sides of the body 2 and suited to allow the visor 8 to be moved between a lowered position and a lifted position.

Figure 2A:
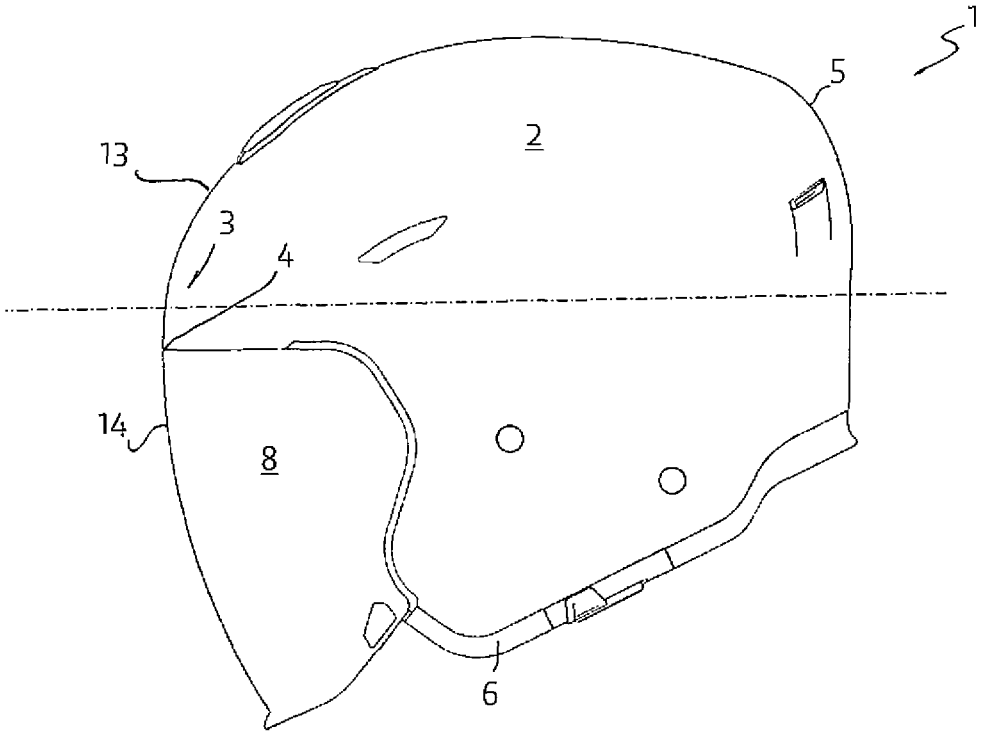

As better illustrated in FIGS. 1A and 2A, when the visor 8 is in the lowered position its upper edge 9 is substantially aligned (or in contact) with the shaped front edge 4 of the body 2.

Figure 1B:
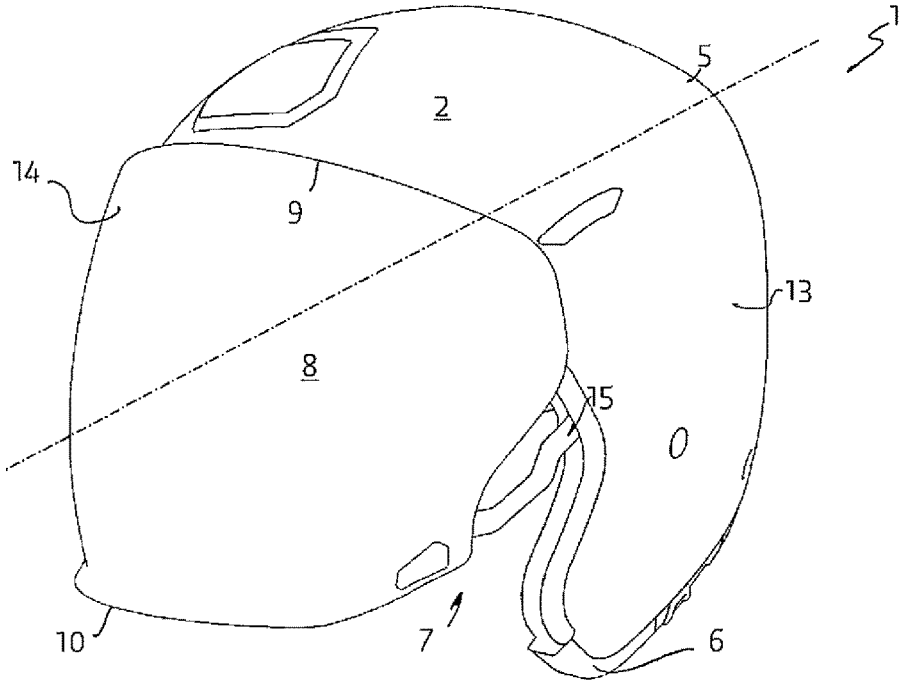
Figure 2B:
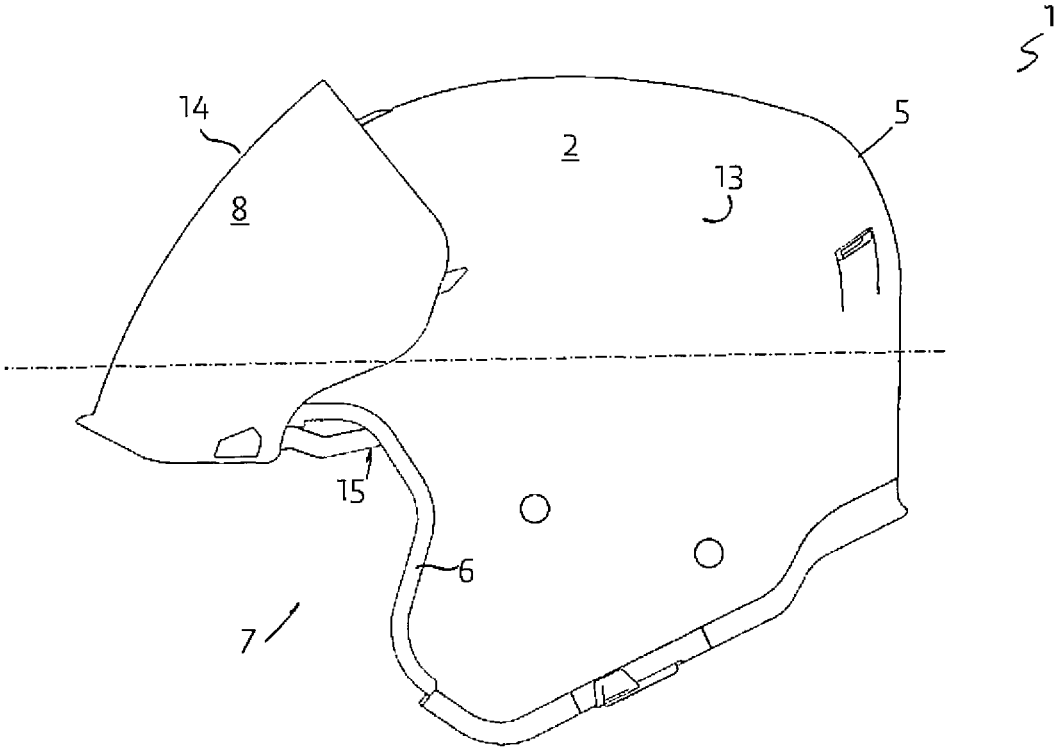

When the visor 8 is in the lifted position its upper edge 9 is positioned above the front edge 4 of the body 2 and is facing towards the back portion 5 of the latter, as better illustrated in FIGS. 1B and 2B.

Conveniently, when the visor 8 is in the lifted position its lower edge 10 can be completely above the front edge 4 of the body 2 or can be positioned slightly below said edge, as in the case of the helmet shown in the Figures.

The handling devices 11 can be anchored to the body 2 in a substantially symmetrical position with respect to a vertical centerline plane IT passing through the body 2 and the opening 7.

More specifically, said devices 11 can be positioned in the area of the body which is substantially at the level of (or near) the user's ears.

The user can selectively move the visor 8 from the lifted/lowered position to the lowered/lifted position using his/her fingers and applying a limited force to the raised lower edge 10 of the visor 8.

Figure 5A:
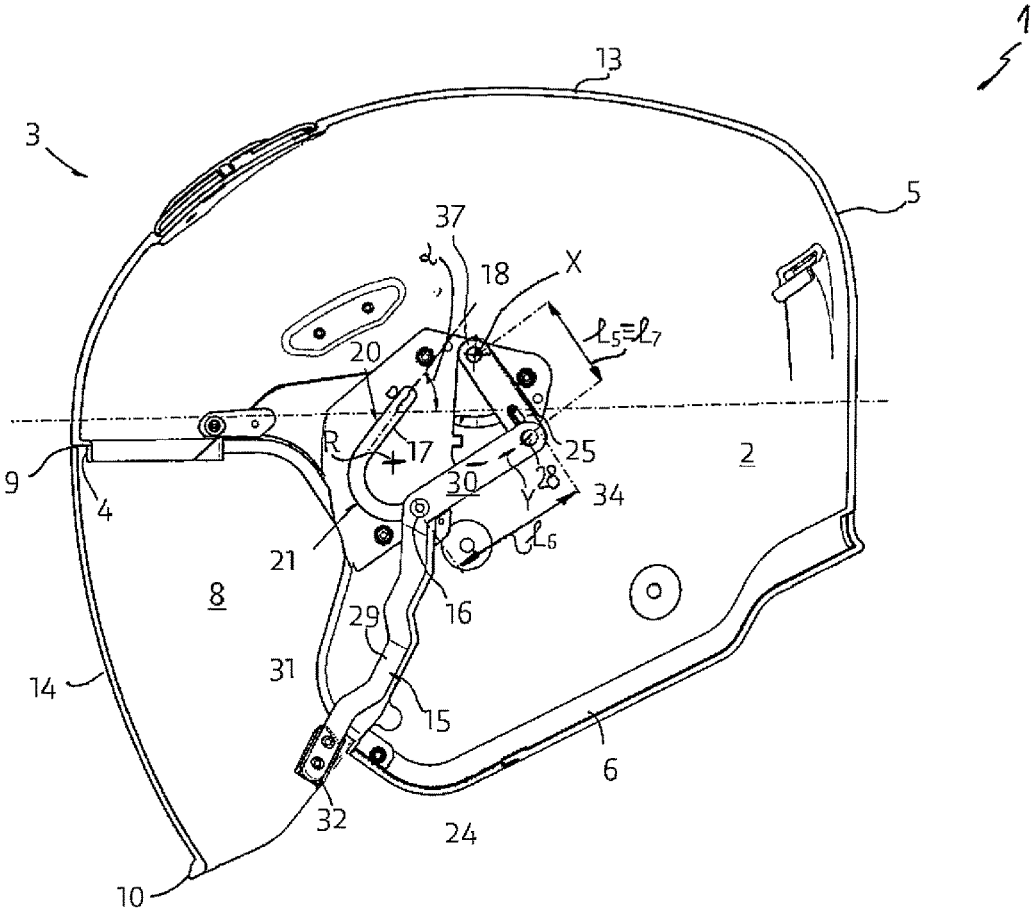
Figure 5B:
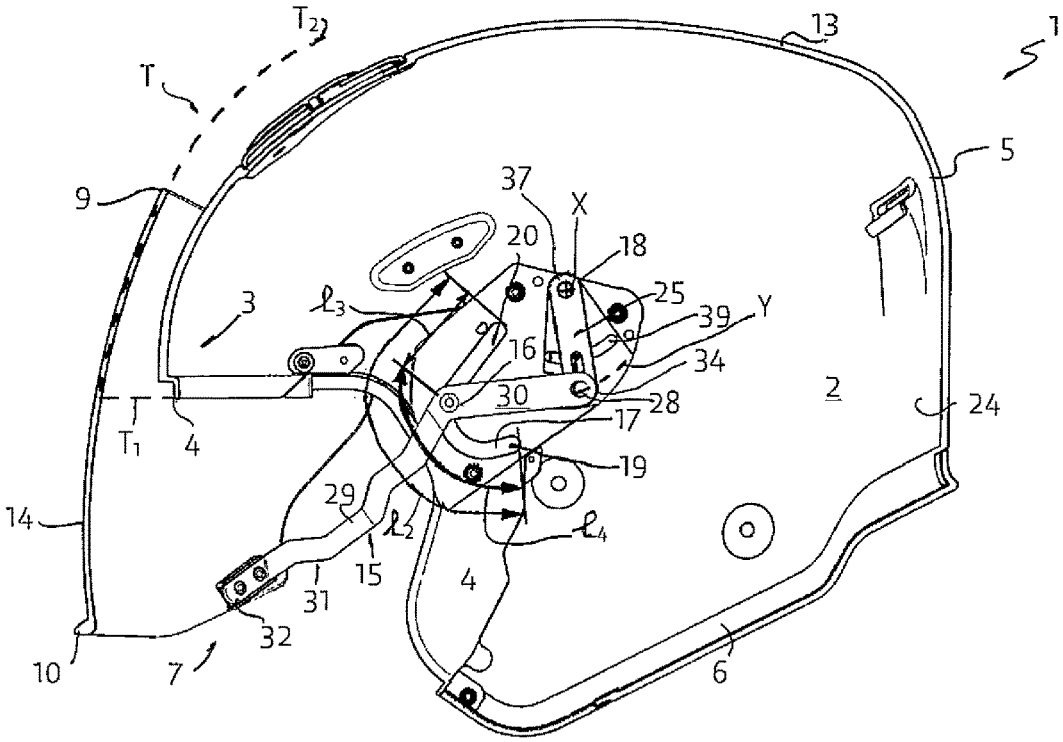
Figure 6A:
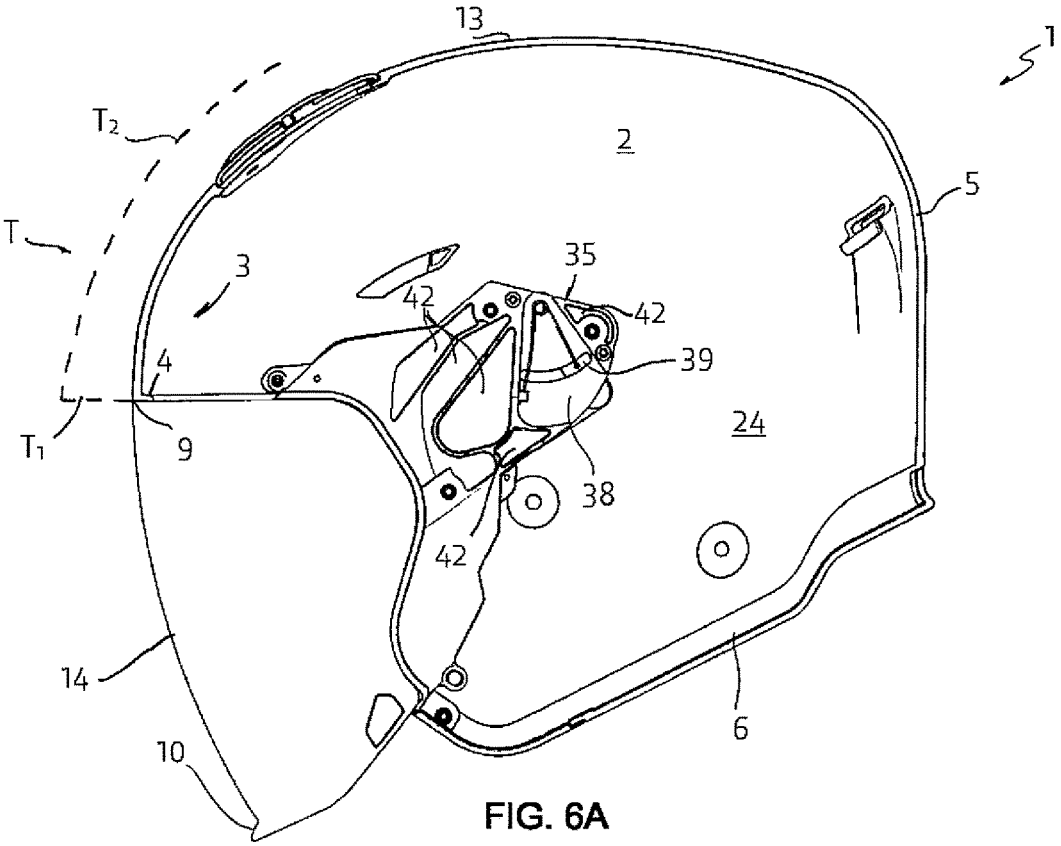
Figure 6B:
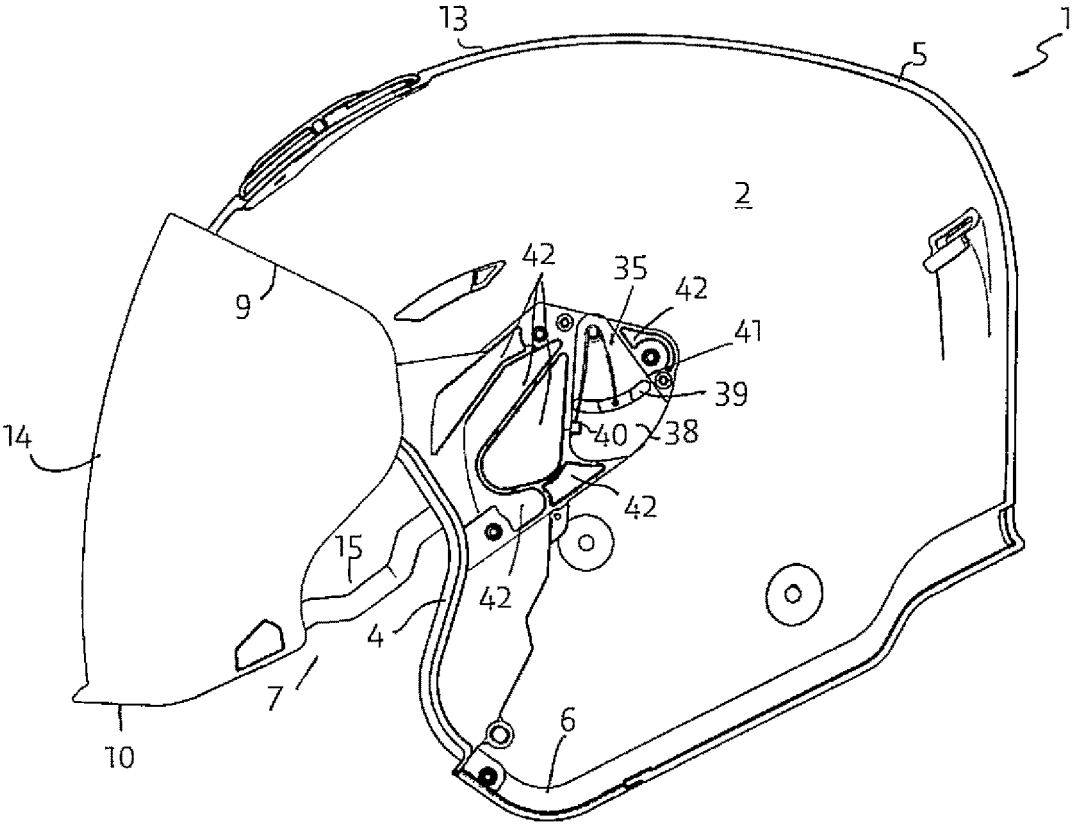

The handling devices 11 will also be suited to allow the user to arrange the visor 4 in a stable manner in one or more intermediate positions between the lowered position and the lifted position, as shown in FIGS. 5B and 6B.

As is better clarified below, the handling devices 11 used in the helmet 1 according to the invention make it possible to promote a rotational-translational movement of the visor 8 between the lifted position and the lowered position.

As can be seen in FIGS. from 5A to 6C, the path T followed by the visor 8 to pass from the lowered position to the lifted position has a first section $T_1$ substantially parallel to a longitudinal axis L passing through the body 2, and then a second, substantially arch-like shaped section $T_2$ in which the visor 8 rotates around a transverse rotation axis R (which passes through the handling devices 11) while maintaining its inner surface 12 at a substantially constant distance from the outer surface 13 of the body 2.

The extension $I_1$ of the first longitudinal section $T_1$ of the path T will be selected in such a way as to prevent the upper edge 9 of the visor 8 (in the lowered position) from projecting beyond the shaped front edge 4 of the body 2.

The outer surface 14 of the visor 8 is shaped in such a way as to follow by continuity the outer surface 13 of the body 2, so as to obtain the substantial coplanarity of these two surfaces 13, 14 as shown in FIGS. 1A, 2A, 5A and 6A.

A visor 8 positioned so that it is "flush" with the body 2 makes it possible to reduce the arising of front aerodynamic turbulence during the use of the helmet, while at the same time improving the stability of the helmet and reducing the noise present inside the body 2.

Conveniently, as can be clearly seen in FIGS. from 4A to 6C, each handling device 11 comprises a first connection member 15 connected to the visor 8, which is associated with a first movable pin 16 designed to be inserted in a properly shaped first seat 17.

Furthermore, there is also a fixed pivot 18 operatively associated with the first connection member 15.

As is better clarified below, the first connection member 15 and the corresponding first pin 16 associated with it are movable with respect to the fixed pivot 18 in order to allow the visor 8 to be moved between the lowered position and the lifted position.

A single handling device 11 is described in detail here below, it being understood that the technical characteristics described with reference thereto are present also in the other device used in the protection helmet that is the subject of the present invention.

The total extension $I_2$ of the first shaped seat 17 will be conveniently selected in such a way as to allow the first movable pin 16 to be positioned at the ends of said seat 17 in the case where the visor 8 is in the lifted position or in the lowered position.

Figure 5C:
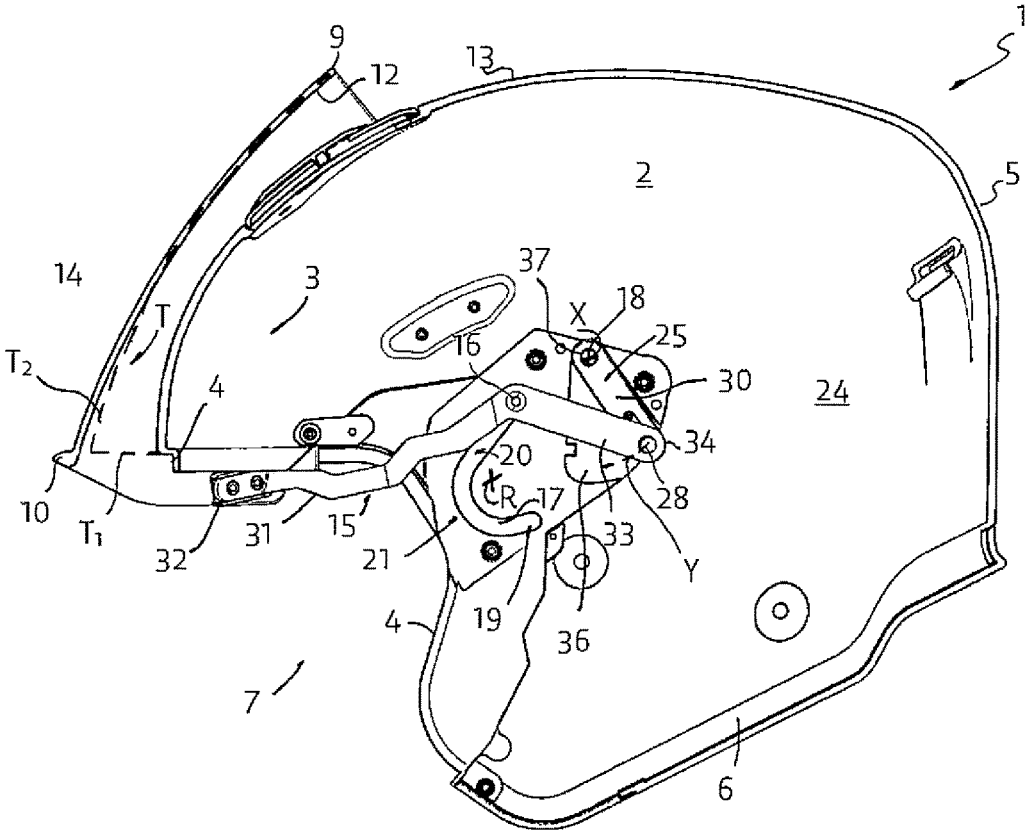

This condition is better illustrated in FIGS. 5A and 5C, where the first seat 17 comprises a lower end section 19 and an upper end section 20 which are respectively straight and are joined to each other through a substantially semi-circular curved intermediate section 21.

More specifically, during the sliding movement of the first movable pin 16 in the lower end section 19, the visor 8 will cover the longitudinal part $T_1$ of the path T, while when said pin 16 moves along the curved intermediate section 21 and the upper end section 20 the visor 8 will move following the remaining part $T_2$ of the path T.

More specifically, as can be seen in FIGS. 5A and 5B, the upper end section 20 of the first seat has an extension $I_3$ which is greater than the extension $I_4$ of the lower end section 19 and is tilted with a predetermined tilting angle $\alpha$ with respect to the longitudinal axis L.

Preferably, this tilting angle $\alpha$ may be included between 45° and 65° and generally be proximate to 55°.

The handling devices 11 may comprise a supporting plate 22 intended to be anchored to the body 2 in a stable manner.

Said plate 22 is shaped in such a way that the fixed pivot 18 (operatively connected to the first connection member 15) is integrated therein, and is also provided with a substantially flat wall 23 on which the first shaped seat 17 has been obtained.

Furthermore, the first connection member 15 is anchored to the plate 22, in such a way as to allow the first movable pin 16 to slide inside the corresponding seat 13.

In practice, the plate 22 makes it possible to support all the components used in the handling devices 11 so as to define with them a unit assembly that can be anchored to the body 2 of the helmet 1 as an independent object.

The plate 22 can be made with two half shells 22', 22", one of which (22') is intended to be anchored to the body 2, while the other (22") will be designed to cover the first half shell 22' so as to form the unit assembly together with it.

Conveniently, the configuration of the plate 22 (or of its half shell 22') and of the inner surface 24 of the body 2 may be properly selected in such a way as to allow the interposition of a structure similar to those of the honeycomb type and adapted to absorb the impacts to which the helmet is subjected at its lateral region.

More specifically, said honeycomb structure can be defined by a series of shaped compartments, indicated as a whole by the reference numeral 42 and visible in the FIGS. 6A and 6B, if necessary made (or interposed) on the inner surface 24 of the body 2 (in proximity to its area connected to the plate 22) and on the outer surface of the wall 23 of the plate 22 (or of the half shell 22').

As can be clearly seen in the Figures, the supporting plates 22 (and therefore the handling devices 11) can be anchored to the inner surface 24 of the body 2 in a mutually opposite position.

Following this assembly operation, the end of the first connection member 15 connected to the visor 8 is always projecting longitudinally with respect to the shaped edge 4 of the body 2, independently of the position assumed by the visor 8.

By inserting the handling devices 11 of the visor 8 inside the body 2, it is possible to make a helmet which is particularly silent and without projections or external sharp edges, which on the contrary are usually present when the handling means are located on the outside of the body.

A body 2 without external projections makes it possible to improve the sliding movement of the helmet on the ground when the user falls and reduces the risk of the latter suffering sudden impacts on his/her cervical spine region.

According to a peculiar characteristic of the present invention, each handling device 11 comprises a second connection member 25, better visible in FIGS. from 4A to 5B, provided with respective ends 26, 27 respectively hinged to the first connection member 15 and to the fixed pivot 18.

The second connection member 25 thus makes it possible to mechanically and operatively connect the first connection member 15 (and consequently the first pin 16) to the fixed pivot 18.

As better illustrated in the Figures, the second connection member 25 can rotate around a rotation axis X passing through the pivot 18.

The other end 27 of the second connection member 25, instead, is hinged to the first connection member 15 at a predetermined hinge point, generally located at the end of the first member 15.

In proximity to this hinge point there is a second movable pin 28 which moves along an arch-like shaped path Y.

The radius of this arch-like shaped path Y is equal to the extension $I_5$ of the second connection member 25.

In the version of the helmet 1 illustrated in the Figures, the first connection member 15 and the second connection member 25 are respectively made with a first rod 29 and a second rod 30.

In the first rod 29 it is possible to identify a lower portion 31 with its end 32 connected to the visor 8 and an upper portion 33 with its end 34 hinged to the second rod 30 through the second movable pin 28.

The portions 31, 33 of the first rod 29 are tilted with respect to each other and at their union point there is the first movable pin 16, slidingly housed inside the first seat 17 obtained on the plate 22.

Furthermore, the end 32 of the lower portion 31 of the first rod 29 is anchored to the visor 8 in proximity to its lower edge 10 and projects from the front edge 4 of the body 2.

Preferably, each handling device 11 may comprise a biasing member 35 suited to exert a counteracting force on the first connection member 15 and/or on the second connection member 25, said counteracting force having a predetermined value and being suited to accompany (or, if necessary, facilitate) the movement of the visor 8 towards the lowered or lifted position.

More specifically, in the configuration of the helmet illustrated in the Figures, the biasing member 35 makes it possible to move the visor 8 both to the lifted position and to the lowered position, and in particular the presence of this component makes it possible to compensate completely for the weight of the visor 8 during the opening step.

Furthermore, the biasing member 35 prevents the visor 8 from lifting accidentally.

In the configuration of the helmet 1 illustrated in the Figures, the biasing member 35 is constituted by a flat spring, even if the expert in the art will certainly understand that this component can be replaced by equivalent elements (for example, a helical spring, a linear actuator etc.).

As better illustrated in FIG. 5A, also the second connection member 25 and the biasing member 35 are mounted on the supporting plate 22.

The wall 23 of the plate, in fact, can be provided with a shaped recess 36 inside which the second connection member 25 is revolvingly anchored.

At the top of the recess 36 it is possible to obtain a cylindrical pivot 18 suited to be inserted in a corresponding hole 37 made in the second connection member 25.

The biasing member 35 can be positioned inside a suitable housing 38 obtained in the wall 23 of the plate 22, on the opposite side with respect to the recess 36 designed to contain the second connection member 25.

In the helmet illustrated in the Figures, the biasing member 35 acts directly on the second connection member 25 and therefore a second substantially semi-circular through seat 39 is provided, which is formed in proximity to the recess 36, where the second connection member 25 is located.

In this way, in the case where the biasing member 35 is constituted by a flat spring, it will be possible to anchor one end 40 of the spring in a fixed position inside the housing 38, while the other end 41 of said spring passes through the second seat 39 in such a way that it is directly anchored to the second connection member 25.

The presence of a housing 38 for the biasing member 35 and of a recess 36 for the second connection member 25 makes it possible to provide a particularly thin plate 22 that is suited to be anchored to the inner surface 24 of the body 2.

The helmet that is the subject of the present invention may also comprise further elements known to the expert in the art and not illustrated in the figures.

For example, the inner surface 24 of the body 2 can be covered with soft padding suited to envelop the user's head and a further visor in a dark colour can be provided, which is suited to protect the user's eyes against solar radiation.

Obviously, also this visor can be selectively movable between two end positions.

The FIGS. from 5A to 6C clearly illustrate the practical operation of the invention.

When the visor 8 is lowered, the first rod 29 is facing downwards and the first movable pin 16 is at the end of the lower section 19 of the first seat 17.

Consequently, the second movable pin 28 is in the most backward point of the path Y, so that the second rod 30 is oriented so as to face the back portion of the helmet (FIGS. 5A and 6A).

When the user acts to lift the visor 8, the first movable pin 16 slides forward along the path defined by the first seat 17. Its movement in the first lower end section 19 allows the longitudinal forward translation of the visor 8 and the spacing of its upper edge 9 from the front edge 4 of the body 2.

When the first pin 16 moves in the semi-circular intermediate section 21 of the first seat 17, the visor 8 performs an upward rotation, remaining at a substantially constant distance from the outer surface 13 of the body 2.

At this stage, the second movable pin 28 moves along its semi-circular path Y in a direction corresponding to that defined by the first rod 29, in such a way as to approach the front edge 4 of the body 2 (FIG. 5B).

During this movement the ends 40, 41 of the spring 35 move near each other and in this way the spring is compressed (FIG. 6B).

When the first movable pin 16 has moved along the entire intermediate section 21 of the first seat 17, the approaching motion of the second rod 30 towards the visor 8 reaches a peak.

In this condition, in fact, the longitudinal distance between the second movable pin 28 and the front edge 4 of the body 2 is minimal.

At this stage, the spring 35 exerts on the second rod 30 the maximum counteracting force oriented in opposite direction to motion. This condition is illustrated in FIGS. 5B and 6B.

If the user keeps lifting the visor 8, the first movable pin 16 will move through the upper straight section 20 of the first seat 17 and this will facilitate the return of the second movable pin 28 towards its initial position as well as the rotation of the second rod 30 in the contrary direction with respect to that of the previous step.

The return of the second rod 30 to the initial position is facilitated also by the action of the spring 35 which exerts on it a biasing force towards the initial condition of balance.

Therefore, in this situation the user can lift the visor 8 completely by exerting a reduced force compared to the force applied the same visor 8 when it is in the lowered position.

During the movement of the visor between its two end positions, the second connection member 25 performs a substantially alternate movement along the path Y having an extension which is delimited by the initial position of the second element 25 and by the point of maximum proximity to the front edge 4 of the body 2.

Figure 6C:
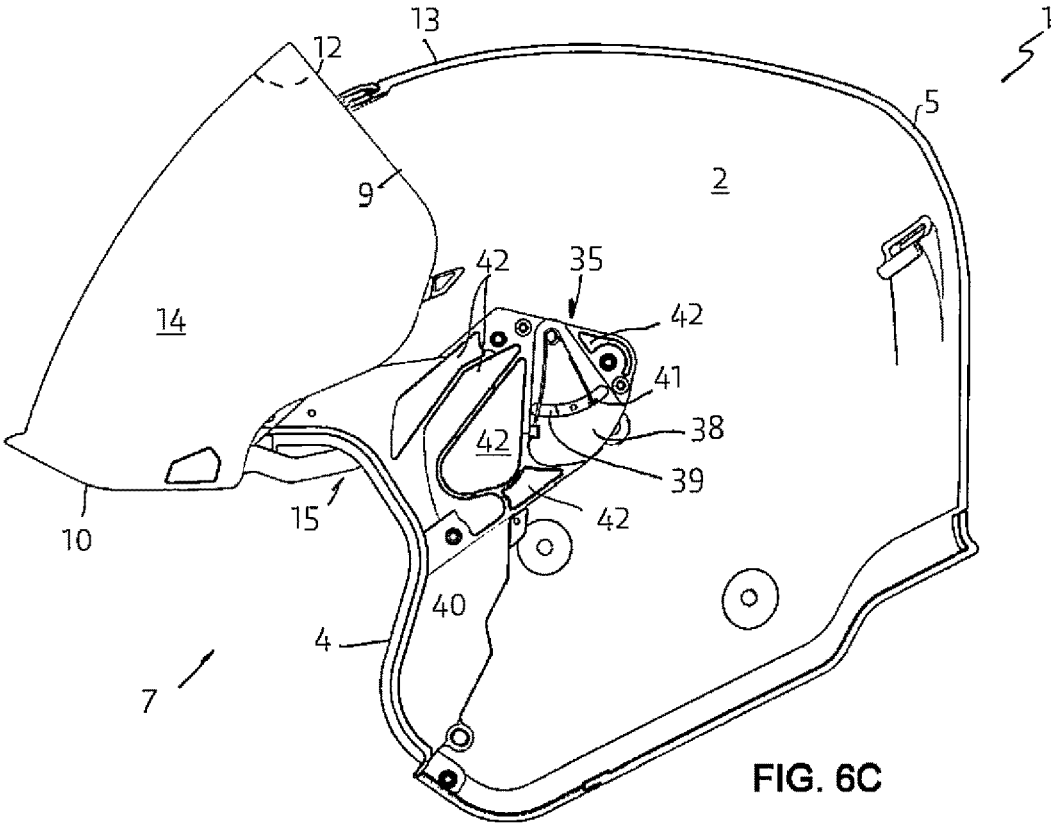

When the visor 8 is completely lifted, the first movable pin 16 is in contact with the end 20 of the first seat 17, while the second movable pin 28 and the second rod 30 are again in the initial position, as clearly illustrated in FIGS. 5C and 6C.

Furthermore, in the lowered position the visor 8, even if it rotates with respect to the fixed pivot 18, is constrained in four points: the fixed pivot 18, the second movable pin 28, the first movable pin 16 and the end 32 of the first connection member 15.

The same steps can be described with reference to the passage of the visor 8 between the lifted position and the lowered position.

As described above, the synergic effect obtained through the special configuration of the elements used in the handling devices 11 and through the presence of the biasing member 25 makes it possible to obtain the effect of "accompanying" the visor towards its final position (lowered or lifted) with a reduced effort by the user.

The dimensions of the components used in the handling devices 11 have been properly calculated in such a way as to a) maximize the accompanying effect obtained through the biasing member, b) facilitate the "flush" position of the visor when lowered, and c) allow the movement of the visor between the two lowered and lifted positions along a trajectory which is substantially parallel to the outer surface of the body.

By indicating the distance between the first movable pin 16 and the second movable pin 25 with the letter $I_6$ and the distance between the second movable pin 28 and the fixed pivot 18 with $I_7$, it is possible to demonstrate experimentally that the objects a)-c) illustrated above can be achieved when the ratio between these two dimensions ($I_6/I_7$) is included between 1.1 and 1.3 and preferably proximate to 1.25.

The present invention can be carried out in other variants, all falling within the scope of the inventive characteristics claimed and described herein; said technical characteristics can be replaced using different technically equivalent elements and materials; the invention can have any shape and size, provided that they are compatible with the intended use.

The reference numerals and signs used in the claims and in the description have the sole purpose of making the text clearer to understand and must not be considered elements intended to limit the technical meaning of the objects or processes they identify.

The invention claimed is:

1. A protection helmet comprising:

a body made of a rigid material, said body being provided with a shaped front edge;

a visor provided with an upper edge;

a pair of handling devices anchored to said body and designed to promote a movement of said visor between a lowered position, wherein an upper edge thereof is substantially positioned in proximity to said front edge of the body, and a lifted position, wherein said upper edge is positioned above said front edge and facing a back portion of said body, wherein each handling device comprises:

a first connection member connected to the visor;

a first movable pin associated with said first connection member;

a first shaped seat designed to house said first movable pin in a sliding manner; and a fixed pivot operatively connected to said first connection member, wherein each handling device comprises a second connection member distinct from said first connection member and having ends respectively hinged to said first connection member and to said fixed pivot, wherein each handling device comprises a biasing member configured to exert a force having a predetermined value on said first connection member and/or on said second connection member, said force being facilitating a movement of said visor towards said lowered position and/or towards said lifted position, wherein each handling device comprises a supporting plate, on which said fixed pivot is formed, said supporting plate being suited to allow a removable anchoring of said first connection member, of said second connection member, and of said biasing member, wherein said supporting plate has a flat wall, on which said first shaped seat for a sliding movement of said first movable pin and a housing for said biasing member are respectively formed, said housing being formed on an opposite side with respect to said fixed pivot and adjacently to said second connection member, wherein said supporting plate has a second through seat formed on said flat wall of said supporting plate adjacently to said housing, and wherein the supporting plate of each handling device is anchored to an inner surface of said body on an opposite side with respect to a centerline plane passing through the body, an end of said first connection member connected to said visor projecting longitudinally from the front edge of said body during a movement of said visor between said lowered position and said lifted position.

2. The protection helmet as claimed in claim 1, wherein at least one portion of said biasing member passes through said second through seat to interact with said second connection member so as to promote a movement of said first movable pin towards ends of said first seat.

3. The protection helmet as claimed in claim 1, wherein said biasing member comprises a spring having a fixed end anchored to the housing and a movable end passing through said second through seat and connected to the second connection member.

* * * * *